US005485722A

United States Patent [19]

Schmidt et al.

[11] Patent Number: 5,485,722

[45] Date of Patent: Jan. 23, 1996

[54] CATALYTIC DECOMPOSITION OF HYDROXYLAMMONIUM NITRATE-BASED MONOPROPELLANTS

[75] Inventors: Eckart W. Schmidt, Bellevue, Wash.; David F. Gavin, Cheshire, Conn.

[73] Assignee: Olin Corporation, Cheshire, Conn.

[21] Appl. No.: 132,980

[22] Filed: Oct. 7, 1993

[51] Int. Cl.[6] ..... C06D 5/00

[52] U.S. Cl. ..... 60/219; 60/218; 588/202; 588/203; 588/245; 588/246

[58] Field of Search ..... 588/202, 203, 588/245, 246; 86/50; 60/218, 219

[56] References Cited

U.S. PATENT DOCUMENTS

| | | | |
|---|---|---|---|
| 3,026,672 | 3/1962 | Sammon | 60/25.4 |
| 3,460,348 | 8/1969 | Pzoell | 60/218 |
| 4,027,476 | 6/1977 | Schmidt | 60/218 |
| 4,517,798 | 5/1985 | Roberts | 60/39.462 |
| 4,527,389 | 7/1985 | Biddle et al. | 60/207 |
| 4,620,415 | 11/1986 | Schmidt | 60/219 |
| 4,927,542 | 5/1990 | Fuchs et al. | 210/711 |
| 4,968,394 | 11/1990 | Dotson et al. | 204/101 |
| 5,062,966 | 11/1991 | Dotson et al. | 210/753 |
| 5,223,057 | 6/1993 | Mueller et al. | 149/45 |

OTHER PUBLICATIONS

Article from Ullman's Encyclopedia of Industrial Chemistry (5th Rev. ed. vol. A13, pp. 528, 1989).

*Primary Examiner*—Ngoclan Mai
*Attorney, Agent, or Firm*—Dale L. Carlson

[57] ABSTRACT

This invention relates to a process for the catalytic decomposition of HAN-based monopropellants using a platinum group or transition metal group catalyst that is preferably a supported metal catalyst and/or wire mesh/expanded metal mesh catalyst for the purpose of generating hot gases. These gases are suitably employed for driving a turbine, vane or piston motor, for rocket propulsion or as a convenient and environmentally acceptable means of disposal of surplus propellants or other waste products containing HAN. The HAN-based propellants have low or substantially no volatility and are safer to use than other monopropellants currently used for rocket propulsion or shaft horsepower auxiliary power units.

18 Claims, No Drawings

CATALYTIC DECOMPOSITION OF HYDROXYLAMMONIUM NITRATE-BASED MONOPROPELLANTS

FIELD OF THE INVENTION

The invention relates generally to hydroxylammonium nitrate, $NH_3OH\ NO_3$ (so-called "HAN"), which is the nitrate salt of hydroxylamine, and more specifically to a process for the controlled catalytic decomposition of HAN.

BACKGROUND OF THE INVENTION

Controlled catalytic decomposition of monopropellants is a preferred method for rocket propulsion and gas generation for rotary power in auxiliary power units. A monopropellant with a long standing history of usage is hydrogen peroxide $H_2O_2$. However, hydrogen peroxide suffers from lack of storage stability and is detonable in high concentrations.

In addition to propellant stability and shock sensitivity issues, there are also volatility and toxicity concerns with respect to many conventional propellants. For example, hydrazine-based monopropellants, which currently serve a wide range of rocket propulsion and auxiliary/emergency power unit gas generator applications in satellites, space shuttles and high performance fighter aircraft, can pose a health risk to service personnel accidentally exposed to hydrazine vapors. Accordingly, there is a need by the propellant community for relatively insensitive propellants characterized by relatively low toxicity and volatility, and new processes for their deployment as monopropellants.

Hydroxylammonium nitrate (so-called "HAN"), which is the nitrate salt of hydroxylamine, is known to be an excellent insensitive oxidizer for liquid gun propellants, as disclosed, for example, in U.S. Pat. No. 4,968,394 which is more specifically directed at a method for reducing excess nitric acid in aqueous hydroxylammonium nitrate solutions.

Of course, as with any propellant, there are risks associated with HAN and related salts. For example, Ullman's Encyclopedia of Industrial Chemistry (5th Rev. ed. Vol. A13, 528, 1989) reports that hydroxylammonium salts decompose on heating, and runaway exothermic decomposition can take place as a result of local heating. Such uncontrolled decomposition can be also promoted by even trace amounts of unwanted heavy metal impurities, particularly, copper, copper-containing alloys and copper salts. These contaminants act as catalysts, typically homogeneous catalysts. This type of catalysis is very undesirable and not a subject of the current patent. In contradistinction, controlled and desirable on-command on-off catalytic decomposition of HAN-based propellants is possible through use of heterogeneous catalysts. Thermal decomposition products of hydroxylammonium sulfate are reported to be sulfur dioxide, dinitrogen monoxide (nitrous oxide), water and ammonium sulfate; the chloride similarly decomposes to hydrogen chloride, nitrogen, water and ammonium chloride. Hydroxylammonium salts react with alkali to give the easily decomposed hydroxylamine free base. With nitrites, decomposition to dinitrogen monoxide occurs. Heating of aqueous solutions of hydroxylammonium salts in the absence of catalysts for long periods at 80° C. leads to slow decomposition. Oxidation of hydroxylammonium salts leads, depending on the oxidant and reaction conditions, to nitrogen compounds in various oxidation states. All these reactions are greatly accelerated in the presence of a catalyst.

Various processes for destroying waste HAN and related salts are known in the art. For example, U.S. Pat. No. 4,927,542 teaches a process for eliminating hydroxylammonium salts from acidic solutions by the use of manganese (IV) oxides. This process, however, introduces undesirable metal ions into the solutions and requires several treatment steps to achieve decomposition to where the effluent can be discharged or disposed of safely, for example, in a navigable waterway.

As another illustration of a process for the disposal of hydroxylammonium salts, U.S. Pat. No. 5,062,966 discloses a process for reacting an aqueous solution of a hydroxylammonium compound which comprises raising the pH of the solution to about 8 or higher and reacting the alkaline solution with a source of hypohalite ions. Unfortunately, the process of the U.S. Pat. No. 5,062,966 requires the use of consumable chlorine or other halogen and tends to produce undesirable halogen by-products such as chloroform, as well as undesirable amine by-products such as nitroamines if it is applied to HAN-based propellants containing aliphatic amine nitrates.

The current invention describes a new process for decomposing HAN in a controlled manner for purposes of disposal of the HAN or to provide controlled decomposition of the HAN in its use as a monopropellant, without requiring a consumable reactant and without undesirable by-product production, which would be highly desired by the military and commercial propellants communities, as well as the waste disposal industry.

The present invention is distinctly different from the method of hybrid rocket propulsion using a highly soluble, non-hazardous hydoxylammonium salt, as described in U.S. Pat. No. 4,527,389 in that it allows the monopropellant reactor rocket engine to operate indefinitely long and continuously or repeatedly as long as a HAN/fuel solution is supplied to the reactor. In contrast, the hybrid rocket can be operated only once and its operating time is limited by the amount of solid propellant in the motor. This difference makes monopropellants useful for attitude control of satellites, divert propulsion of kinetic kill vehicles and auxiliary power supplies which cannot be powered by a hybrid rocket. At the start of a hybrid rocket, liquid oxidizer and solid propellant are in separate containers, whereas in a monopropellant the HAN oxidizer and fuel are dissolved intimately in a solvent and contained in a common tank.

The key to successful operation of a monopropellant-powered rocket is the catalyst, whereas the hybrid rocket motor in U.S. Pat. No. 4,527,389 operates without a catalyst.

SUMMARY OF THE INVENTION

In one aspect, the present invention relates to the controlled decomposition of a liquid propellant composition containing HAN which comprises contacting the liquid propellant with a solid catalyst comprising an active metal component selected from the group consisting of platinum group metals, transition group metals, and combinations thereof, in order to cause said HAN to decompose to produce a gaseous working fluid comprising water in the form of steam, carbon dioxide and nitrogen.

In another aspect, the present invention relates to a continuous process for the controlled generation of a gaseous working fluid which comprises the steps of:

(a) passing a first measured amount of a HAN-containing liquid into a reactor containing a solid catalyst selected from the group consisting of platinum group metals, transition group metals, and combinations thereof, to cause the HAN to decompose into a high-pressure gaseous product comprising water in the form of steam, carbon dioxide and nitrogen, (b) controllably exhausting said high-pressure gaseous product from the reactor and maintaining the flow rate of a HAN-containing liquid into the reactor to cause the reactor chamber pressure to remain essentially constant, and (c) repeating steps (a) and (b) in a continuous fashion.

In yet another aspect, the present invention relates to a process for the controlled destruction of liquid waste containing HAN which comprises passing the liquid waste into a heated reactor and contacting said liquid waste in the reactor with a solid catalyst selected from the group consisting platinum group metals, transition group metals, and combinations thereof, to cause the HAN and associated fuel in said liquid waste to decompose into a gaseous product comprising water in the form of steam, carbon dioxide and nitrogen, all innocuous and environmentally acceptable reaction products.

These and other aspects will become apparent upon reading the following detailed description of the invention.

DETAILED DESCRIPTION OF THE INVENTION

It has now been surprisingly found in accordance with the present invention that a liquid propellant (advantageously a monopropellant) containing HAN is suitably decomposed in a controlled manner by contacting a predetermined amount of the propellant with a select solid (i.e., heterogeneous) catalyst to cause the HAN to decompose into a "working fluid" comprising water in the form of steam, carbon dioxide and nitrogen. The "working fluid" can then be used as desired, e.g. to provide rocket propulsion or rotary power for auxiliary power units. Likewise, the process of the present invention is suitably employed to treat waste streams containing HAN in order to decompose the HAN and dissolved fuels contained therein.

Thus, the present invention provides a process for the catalytic decomposition of HAN-based monopropellants using a platinum group or transition group metal catalyst that is preferably a supported metal catalyst and/or wire mesh/expanded metal mesh catalyst for the purpose of generating gases, normally hot gases at high pressure as a result of the reaction exotherm which is produced. These gases are suitably employed for driving a turbine, vane motor, or piston motor, for rocket propulsion or as a convenient and environmentally acceptable means of disposal of surplus propellants or other waste products containing HAN. The HAN-based propellants have low or substantially no volatility and are safer to handle than other monopropellants currently used for rocket propulsion or shaft horsepower auxiliary power units.

The catalyst employed in the process of the present invention is suitably a solid catalyst having an active metal component which is selected from the group consisting of platinum group metal catalysts, transition metal group catalysts, and combinations thereof. The solid catalyst is suitably either a supported catalyst or an unsupported catalyst. If an unsupported catalyst is used, the active metal itself can be configured into a sponge or skeletal (wire mesh) configuration. If a supported catalyst is used, an alumina support is preferred, although other relatively inert metal or ceramic support materials can be used instead of, or in combination with, the alumina. A variety of supported catalysts are commercially available, such as Shell 405 catalyst (32% iridium on alumina) or one of the LCH series of catalyst such as LCH-207 (32% iridium on alumina), LCH210 (10% platinum on alumina), and LCH-215 (12% rhodium on alumina), products of Rocket Research Company.

When employing a HAN-based monopropellant in the process of this invention, the propellant can suitably contain a fuel, such as the commonly used triethanolammonium nitrate, or another such fuel, such as hydroxylamine (free base), dimethylhydroxylammonium nitrate, diethylhydroxylammonium nitrate, diethylhydroxylamine (free base), triethylenediamine dinitrate, diethylenetriamine dinitrate, ethylenediamine dinitrate, methylammonium nitrate, dimethylammonium nitrate, trimethylammonium nitrate, methylhydrazinium nitrate, ethylenedihydrazinium dinitrate, hydroxyethylhydrazinium nitrate, di(hydroxyethyl)hydrazinium(1+) nitrate, hydrazinium (1+) formiate, hydrazinium (1+) acetate, hydrazinium (1+) carbazate, hydrazinium (1+) aminoacetate, triaminoguaninidium nitrate, carbohydrazide, carbohydrazide (1+) nitrate, carbohydrazide (2+) dinitrate, urea, formamide, N-methylformamide, N,N-dimethylformamide, guanidinium nitrate, 1,4-bis-cubanediammonium dinitrate, 3-nitro-1,2,4-triazol(5)one hydrazinium salt, 3-nitro-1,2,4-triazol(5)one ammonium salt, N-methyl-2-pyrrolidone, aziridine-derivatives, azetane derivatives, and combinations thereof.

An initiator is optionally employed in the process of the present invention in order to initiate the HAN decomposition reaction in the presence of the catalyst. The initiator can, if desired, be incorporated into a supported catalyst system to provide a so-called "one-shot catalyst". Suitable initiators include $[NO_2]\ BF_4$, $[NO_2]\ ClO_4$, $I_2O_5$ and $[NO_2]\ ClF_4$, and combinations thereof.

The HAN decomposition reaction of the process of this invention is suitably enhanced by the optional incorporation of thermally conductive path elements (such as metal foam as described in U.S. Pat. No. 4,027,476, wires or rods) into the catalyst bed itself or by employing the reaction exotherm by recirculating at least a portion of the hot gases from the initial HAN decomposition into a regenerative heat exchanger.

Although the HAN solutions employed in the process of this invention are normally in liquid form, gelled HAN can alternatively be employed in order to minimize propellant spillage in the event of a leak.

The controlled HAN decomposition reaction in accordance with the process of the present invention is suitably initiated at an elevated temperature, preferably at a temperature of between about 50° C. and about 250° C., more preferably at a temperature of between 80° C. and 120° C.

The rate of the HAN decomposition reaction is suitably controlled by regulating the flow of HAN-based propellant through the reactor containing the catalyst and by choking the exit flow from the reactor in a sonic flow nozzle which is part of a rocket or a turbine. In this manner, a runaway reaction or unwanted detonation of the HAN-containing waste or propellant is avoided.

EXAMPLES

Example 1

Iridium on Alumina Catalyst

A catalyst consisting of 32 iridium deposited on high-surface area alumina was placed in a test tube, preheated to 80° C., and a solution consisting of 60.79% hydroxylammonium nitrate, 19.19% triethanolammonium nitrate and 20.02% water (in the following called LP-1846) was added dropwise to the catalyst while measuring the temperature with a thermocouple and recording the events with a video camera on a video recorder. A strong exothermic reaction was noted with each addition of propellant, the catalyst temperature increased, and the catalyst became red hot.

Example 2

Platinum on Alumina Catalyst

A catalyst consisting of 10% platinum deposited on a high-surface area alumina was mixed with an equal volume of LP-1846 at room temperature and the mixture was heated gradually with a thermocouple inserted to measure the onset of exothermic reaction. The onset of exothermic reaction was 113° C. as indicated by a sudden rise of the catalyst temperature, gas evolution, and consumption of all the liquid propellant.

Example 3

Ruthenium on Alumina Catalyst

A catalyst consisting of 12% ruthenium deposited on a high-surface area alumina was mixed with an equal volume of LP-1846 and the mixture was heated gradually with a thermocouple inserted to measure the onset of exothermic reaction. The onset of exothermic reaction was 115° C. as indicated by a sudden rise of the catalyst temperature, gas evolution, and consumption of all the liquid propellant.

Example 4

Platinum/Tantalum Sheet Catalyst

Several pieces of expanded tantalum sheet clad with platinum foil were rolled together, preheated to 250° C., and LP-1846 was added dropwise. There was an exothermic reaction and the propellant decomposed with gas evolution.

While the invention has been described above with reference to specific embodiments thereof, it is apparent that many changes, modifications and variations can be made without departing from the inventive concept disclosed herein. Accordingly, it is intended to embrace all such changes, modifications and variations that fall within the spirit and broad scope of the appended claims. All patent applications, patents and other publications cited herein are incorporated by reference in their entirety. All percentages given herein are on a weight basis unless otherwise specified.

What is claim

1. A process for a controlled decomposition of a liquid monopropellant composition containing hydroxylammonium nitrate which comprises contacting the liquid monopropellant with a solid catalyst comprising an active metal component selected from the group consisting of platinum group metal, transition group metals, and combinations thereof, in order to cause said hydroxylammonium nitrate to decompose to produce a gaseous propellent comprising water in the form of steam, carbon dioxide and nitrogen.

2. The process of claim 1 wherein said monopropellant composition additionally comprises a nitrate salt of an organic or inorganic amine as a fuel.

3. The process of claim 1 wherein said monopropellant composition comprises an aqueous solution or a non-aqueous free amine solution.

4. The process of claim 1 wherein the active metal component of said catalyst is selected from the group consisting of platinum, iridium, ruthenium, rhodium and combinations thereof.

5. The process of claim 1 wherein said catalyst is a supported catalyst comprising said active metal component on an inert solid support.

6. The process of claim 5 wherein said supported catalyst additionally comprises a hypergolic consumable solid oxidizer selected from the group of: $[NO_2]BF_4$, $[NO_2]ClO_4$, $I_2O_5$ and $[NO_2]ClF_4$, and combinations thereof.

7. The process of claim 5 wherein said solid inert support is alumina.

8. The process of claim 1 wherein said monopropellant composition addiitionally comprises a fuel selected from the group consisting of: triethanolammonium nitrate hydroxylamine (free base), dimethylhydroxylammonium nitrate, diethylhydroxylammonium nitrate, diethylhydroxylamine (free base), triethylenediamine dinitrate, diethylenetriamine dinitrate, ethylenediamine dinitrate, methylammonium nitrate, dimethylammonium nitrate, trimethylammonium nitrate, methylhydrazinium nitrate, ethylenedihydrazinium dinitrate, hydroxyethylhydrazinium nitrate, di(hydroxyethyl)hydrazinium(1+) nitrate, hydrazinium (1+) formiate, hydrazinium (1+) acetate, hydrazinium (1+) carbazate, hydrazinium (1+) aminoacetate, triaminoguaninidium nitrate, carbohydrazide, carbohydrazide (1+) nitrate, carbohydrazide (2+) dinitrate, urea, formamide, N-methylformamide, N,N-dimethylformamide, guanidinium nitrate, 1,4-bis-cubanediammonium dinitrate, 3-nitro-1,2,4-triazol(5)one hydrazinium salt, 3-nitro-1,2,4-triazol(5)one ammonium salt, N-methyl-2-pyrrolidone, aziridine-derivatives, azetane derivatives, and combinations thereof.

9. A continuous process for the controlled generation of a gaseous propellant which comprises the steps of:

(a) passing a first measured amount of a hydroxylammonium nitrate-containing liquid into a reactor containing a solid catalyst selected from the group consisting of platinum group metals, transition group metals, and combinations thereof, to cause the hydroxylammonium nitrate to decompose into a high pressure gaseous product comprising water in the form of steam, carbon dioxide and nitrogen, (b) controllably exhausting said high-pressure gaseous product from the reactor and maintaining the flow rate of hydroxylammonium nitrate-containing liquid into the reactor to cause the reactor chamber pressure to remain essentially constant, and (c) repeating steps (a) and (b) in a continuous fashion.

10. The process of claim 9 wherein said propellant composition additionally comprises a nitrate salt of an organic or inorganic amine as a fuel.

11. The process of claim 9 wherein said propellant composition comprises an aqueous solution or a non-aqueous free amine solution.

12. The process of claim 9 wherein the catalyst is selected from the group consisting of platinum, iridium, ruthenium, rhodium and combinations thereof.

13. The process of claim 9 wherein said catalyst is a supported catalyst comprising said active metal component on an inert solid support.

14. The process of claim 13 wherein said supported catalyst additionally comprises a hypergolic consumable solid oxidizer selected from the group consisting of: $[NO_2]$ $BF_4$, $[NO_2]ClO_4$, $I_2O_5$ and $[NO_2]ClF_4$, and combinations thereof.

15. The process of claim 13 wherein said solid support is alumina.

16. The process of claim 9 wherein said propellant composition additionally comprises a fuel selected from the group consisting of: hydroxylamine (free base), dimethylhydroxylammonium nitrate, diethylhydroxylammonium nitrate, diethylhydroxylamine (free base), triethylenediamine dinitrate, diethylenetriamine dinitrate, ethylenediamine dinitrate, methylammonium nitrate, dimethylammonium nitrate, trimethylammonium nitrate, methylhydrazinium nitrate, ethylenedihydrazinium dinitrate, hydroxyethylhydrazinium nitrate, di(hydroxyethyl)hydrazinium(1+) nitrate, hydrazinium (1+) formiate, hydrazinium (1+) acetate, hydrazinium (1+) carbazate, hydrazinium (1+) aminoacetate, triaminoguaninidium nitrate, carbohydrazide, carbohydrazide (1+) nitrate, carbohydrazide (2+) dinitrate, urea, formamide, N-methylforamide, N,N-dimethylformamide, guanidinium nitrate, 1,4-bis-cubanediammonium dinitrate, 3-nitro-1,2,4-triazol(5)one hydrazinium salt, 3-nitro-1,2,4-triazol(5)one ammonium salt, N-methyl-2-pyrrolidone, aziridine-derivatives, azetane derivatives, and combinations thereof.

17. A process for the controlled destruction of liquid waste containing hydroxylammonium nitrate which comprises passing the liquid waste into a reactor and contacting said liquid waste in the reactor with a solid catalyst selected from the group consisting platinum group metals, transition group metals, and combinations thereof, to cause the hydroxylammonium nitrate and associated fuel in said liquid waste to decompose into a gaseous product comprising water in the form of steam, carbon dioxide and nitrogen.

18. A process for a controlled decomposition of a liquid monopropellant composition of hydroxylammonium nitrate and triethanolammonium nitrate which comprises contacting the composition with a solid catalyst comprising an iridium active metal component in order to cause said hydroxylammonium nitrate to decompose to produce a gaseous propellant comprising water in the form of steam, carbon dioxide and nitrogen.

* * * * *

UNITED STATES PATENT AND TRADEMARK OFFICE

CERTIFICATE OF CORRECTION

PATENT NO. : 5,485,722

DATED : January 23, 1996

INVENTOR(S) : Eckart W. Schmidt
David F. Gavin

It is certified that error appears in the above-indentified patent and that said Letters Patent is hereby corrected as shown below:

At column 4, line 22 please delete "N-methylforamide" and insert --N-methylformamide--;

At column 5, line 55 please delete "What is claim" and insert --What is claimed is:--;

At column 6, line 13 a number of letters were inadvertently set in subscript font, therefore please delete "...$O_{5\ \text{and}\ [NO2]}$" and insert --$O_5$ and $[NO_2]$--;

At column 6, line 17 please delete "addiitionally" and insert --additionally--;

At column 6, line 31 please delete "N-methylforamide" and insert --N-methylformamide--; and At column 7, line 19 please delete "N-methylforamide" and insert --N-methylformamide--.

Signed and Sealed this

Ninth Day of July, 1996

*Attest:*

Bruce Lehman

BRUCE LEHMAN

*Attesting Officer*

*Commissioner of Patents and Trademarks*